US008276306B2

(12) United States Patent
Lickteig

(10) Patent No.: US 8,276,306 B2
(45) Date of Patent: Oct. 2, 2012

(54) REAR FIREARM GRIP SUPPORT ROD AND AIMING METHOD

(76) Inventor: Shane Lickteig, Mesa, AZ (US)

( * ) Notice: Subject to any disclaimer, the term of this patent is extended or adjusted under 35 U.S.C. 154(b) by 0 days.

(21) Appl. No.: 13/083,316

(22) Filed: Apr. 8, 2011

(65) Prior Publication Data

US 2011/0247256 A1 Oct. 13, 2011

Related U.S. Application Data

(60) Provisional application No. 61/323,743, filed on Apr. 13, 2010.

(51) Int. Cl.
*F41A 29/00* (2006.01)

(52) U.S. Cl. ..... 42/94; 42/71.01; 42/73; 211/64

(58) Field of Classification Search ..... 42/71.01, 42/73, 71.02, 94; 211/64
See application file for complete search history.

(56) References Cited

U.S. PATENT DOCUMENTS

| | | | | |
|---|---|---|---|---|
| 4,266,748 | A | 5/1981 | Dalton | |
| 4,345,398 | A | 8/1982 | Pickett | |
| 4,676,021 | A | 6/1987 | Groba | |
| 4,876,814 | A | 10/1989 | Lombardo | |
| 6,305,116 | B1 | 10/2001 | Parker | |
| 7,124,528 | B2 | 10/2006 | Long | |
| 7,658,029 | B1 * | 2/2010 | Moody et al. | 42/72 |
| 2005/0241206 | A1 * | 11/2005 | Teetzel et al. | 42/72 |

* cited by examiner

*Primary Examiner* — J. Woodrow Eldred

(57) ABSTRACT

The present invention is a support rod that extends from the rear grip of a firearm with portable convenience features of quick, course adjustment, and slow, fine adjustment of the firearm without the shooter removing his hands from their normal firing position during aiming. The support rod is extended, retracted and adjusted by a button, spring, and a knob in the rear grip of the firearm.

2 Claims, 4 Drawing Sheets

REAR FIREARM GRIP SUPPORT ROD AND AIMING METHOD

CROSS REFERENCE TO RELATED APPLICATIONS

This application claims the benefit of U.S. Provisional Application No. 61/323,743, filed on Apr. 13, 2010.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION (1) Field of the Invention

This invention is directed to the field of firearms, and in particular, to convenient, portable equipment that improves the accuracy and fatigue of aiming and shooting firearms. It is particularly useful for, but not limited to, longer barreled projectile discharging equipment, or firearms, i.e. rifles and shotguns, that use a front stabilizing device, i.e. bipod or sandbag.

(2) Description of Related Art

Others have attempted to improve the accuracy of shooting equipment. U.S. Pat. No. 4,266,748 is an example of a portable tripod that stabilizes a firearm. Although this is an improvement with regard to certain narrow situations, it has very little practical use. The tripod in actual use is bulky when spread out, the shooter must sit in one position, and the shooter must find a very favorable spot which would provide cover for such a highly elevated shooting position.

U.S. Pat. No. 4,345,398 is an example of a telescoping monopod which provides portable support under a firearm for a shooter. This has improved flexibility in that the elevation of the gun during shooting has a much broader range, but it is limited in that the shooter has only one support point on the rifle. Accuracy is not as well defined because the shooter must provide for stabilization by the use of holding the firearm with his hands, arm, and ultimately, his body.

U.S. Pat. No. 4,676,021 is a similar example of a telescoping monopod. It is an improvement over a tree branch with a fork.

U.S. Pat. No. 4,876,814 is an attempt to provide for a back stabilization of a shooting firearm by using a support under the buttstock. An aiming adjustment is provided by a vertical sliding plate which may be locked in place. The adjustment is meant to be used in conjunction with a front stabilization procedure to provide improved aiming accuracy. This has important limitations in convenience and practical use. The shooter will find it very awkward to use a hand to make necessary adjustments in the rear position adjustment while attempting to line up a shot. Also, the elevation adjustment is split between a pivoting and sliding adjustment. It appears that larger adjustments are by positioning the vertical slide on the vertical shaft, and the finer adjustments are by pivoting the buttstock, i.e. twisting the gun. This would be unappealing to a shooter, and require a lot of time to line up a shot.

U.S. Pat. No. 6,305,116 is another example of an adjustment on the rear portion of a firearm. A spring loaded tube extends from the buttstock and additionally includes a threaded pad at the end of the tube. It is described as useful for stabilizing the gun in the field and the firing range where the shooting is at a fixed target. This has important limitations in actual use. It is very inconvenient for a shooter to remove one hand from the firearm and adjust the rear stabilizing mechanism. The shooter no longer has both hands on the firearm in the ready, shoot position. Also, the adjustment is by rotation of the threaded rod with the foot pad at the end which rests on the ground. If the foot pad is resting upon un-stabilized dirt or gravel the rotation will add instability to the aiming adjustment which will be frustrating for the shooter. This is a very undesirable method of aiming adjustment. Likewise, U.S. Pat. No. 7,124,528 has similar problems with adjustment, convenience and storage.

BRIEF SUMMARY OF THE INVENTION

The present invention is a support rod that is stored in the rear grip of a firearm and extends out to the shooters desired length. Rod length is controlled quickly by an activation button and a spring, and slowly by an activation button used as a finely tuned adjustment knob. The supporting rod is extended and adjusted conveniently without the need for the shooter to take his/her hands from the normal firing position during aiming.

BRIEF DESCRIPTION OF THE SEVERAL VIEWS OF THE DRAWING(S)

DETAILED DESCRIPTION OF THE INVENTION

An important feature of the invention is a support rod that is stored in the rear firearm grip handle. In one embodiment, the support rod is a solid rod; in another embodiment, the support rod is telescoping. Also, the support rod is optionally a multi-pod, i.e. a bipod or a tripod.

The support rod is extended and retracted quickly by use of a button, and slowly by a rotating knob, which is activated by the shooter's rearward hand that is used for firing the weapon. In one embodiment, the thumb is used to activate the button on the side of the grip. In alternate embodiments, other fingers of the shooting hand are used to activate the button on the front middle of the grip.

In an embodiment of the present invention, the support rod is fully extended by pressing an activation button and the rod is pushed out of the grip by a spring. The support rod is fully stored by reinserting it into the grip manually and the activation button then holds it in place. Alternately, a locking mechanism holds it in place.

Additionally, the support rod length is continuously adjustable by pressing and holding the button. When the button is pressed continuously, the extension rod is not locked into place and the gun may be raised or lowered manually while the target is being sighted by the shooter (the spring keeps the rod touching the shooting surface). When the shooter has the desired gun position, the button is released and the support rod is locked into place. This provides an important method of obtaining a quick and accurate shot while both hands of the shooter are in the firing position.

In another embodiment of the present invention, the support rod is adjustable by rotating a knob that is conveniently available to a shooter's finger, such a thumb. By rotating the adjustment knob, an internal gear or belt is activated and small teeth on the rod are used to position the gun relative to the rod. This provides for fine control and allows the shooter to obtain a very accurate shot, depending upon how fine an adjustment is designed into the rotation of the knob.

Figure 1A:
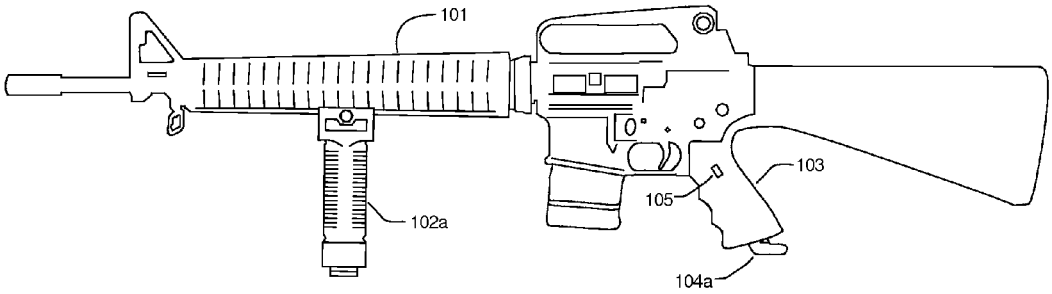
FIG. 1 is a general arrangement of the support rod that is extended from the grip of the firearm.

FIG. 1A is an illustration of an embodiment of the invention. The firearm 101 has a front bipod grip support 102*a*, (or an alternate means of stabilization, such as a monopod, tripod, or field object, not shown), a grip handle 103, which has an internal spring loaded support rod 104*a*, which is shown retracted into the grip handle 103. The support rod 104*a* is released by button 105 down toward the shooting surface 106. The button 105 is pressed by a thumb or finger of the shooter (depending on the exact button location). In an embodiment of the invention, the button 105 is spring loaded.

Figure 1B:
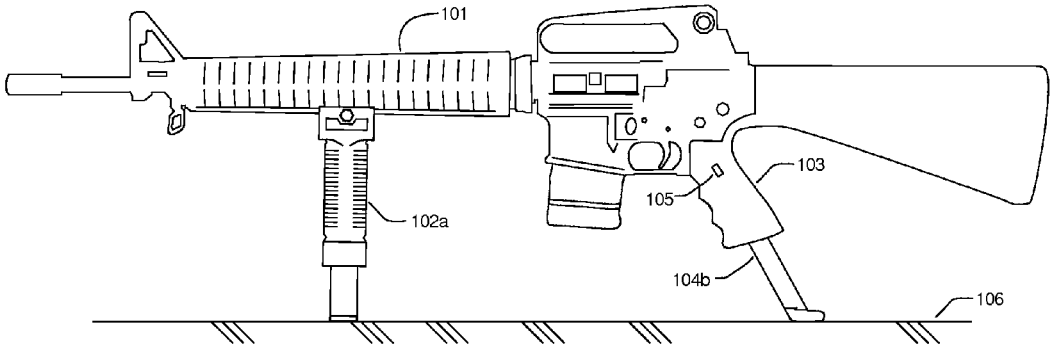

FIG. 1B shows the support rod 104*b* in the extended position, and shows the bipod grip support 102*b* after it has been extended into stabilizing position. As shown in FIG. 1B, the firearm is in a very stable position on the shooting surface, and the shooter has an advantage in positioning the firearm on a target with both hands in firing position.

The shooter uses the spring loaded button 105 for quick, course adjustment by continuously pressing the button 105, which keeps the support rod under spring loaded tension against the shooting surface. When the firearm is sighted on or near the target, the shooter releases the button and the rod length is set. This method provides additional stability and lessens the fatigue to the shooter while aiming.

Figure 2:
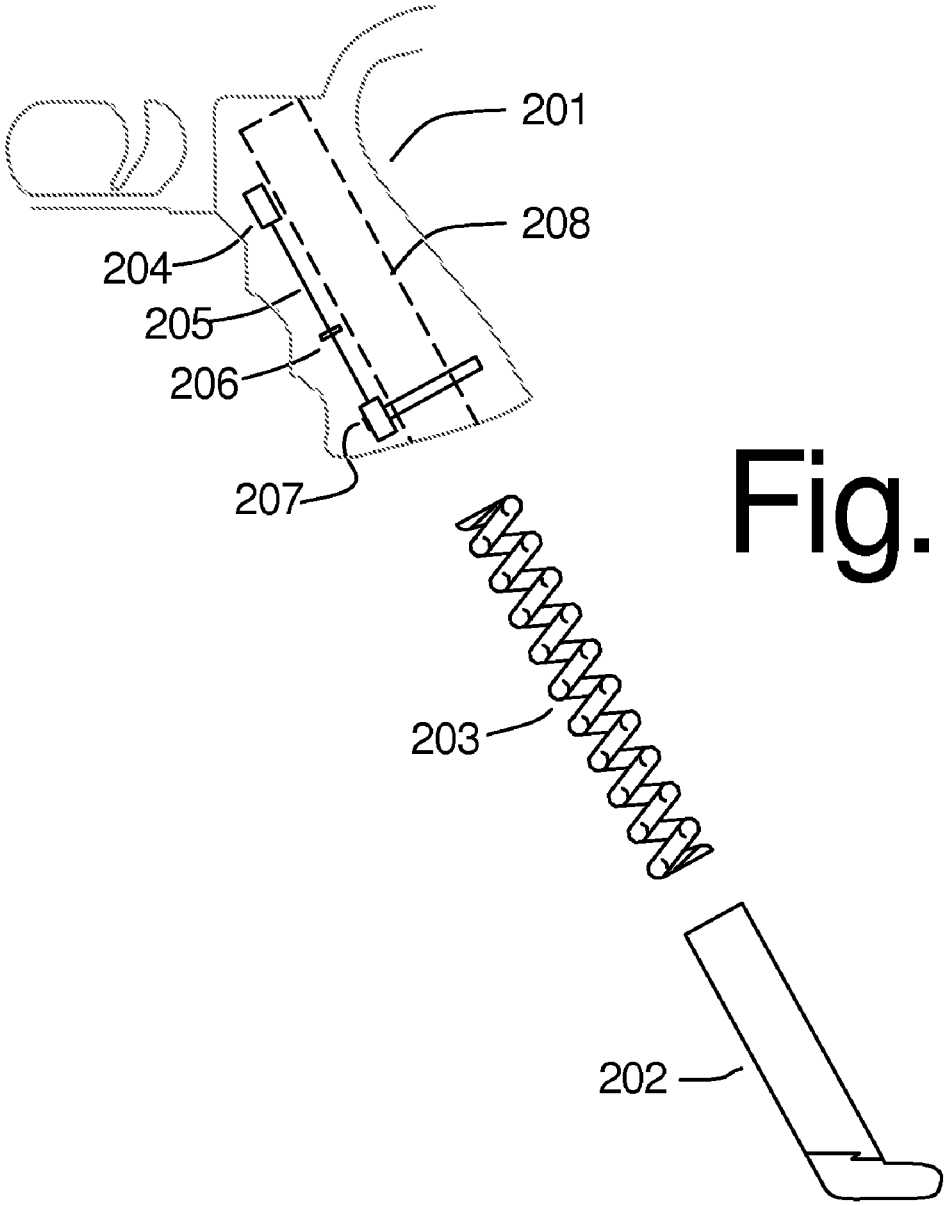
FIG. 2 is an exploded view of the grip assembly.

FIG. 2 is a partially exploded view of the grip assembly. The grip 201 has a hollow chamber 208 where the support rod 202 and spring 203 are inserted. An activation button 204 is used to move a lever rod 205 on a side of a fulcrum rod 206 which releases a clamping mechanism 207 at the lower part of the grip. The button is thereby used to clamp and release the rod by the shooter while aiming. The spring keeps the extension rod extended against the shooting surface so that the gun is constantly braced.

In another embodiment of the present invention, the button which activates the support rod is designed to provide very fine control by rotating it. That is, the button is part of a fine gearing or belt system to allow the shooter to make very small incremental changes to the position of the rod. When shooting at long distance targets, this method of aiming is helpful to provide the accuracy needed to put the firearm properly on target.

Figure 3:
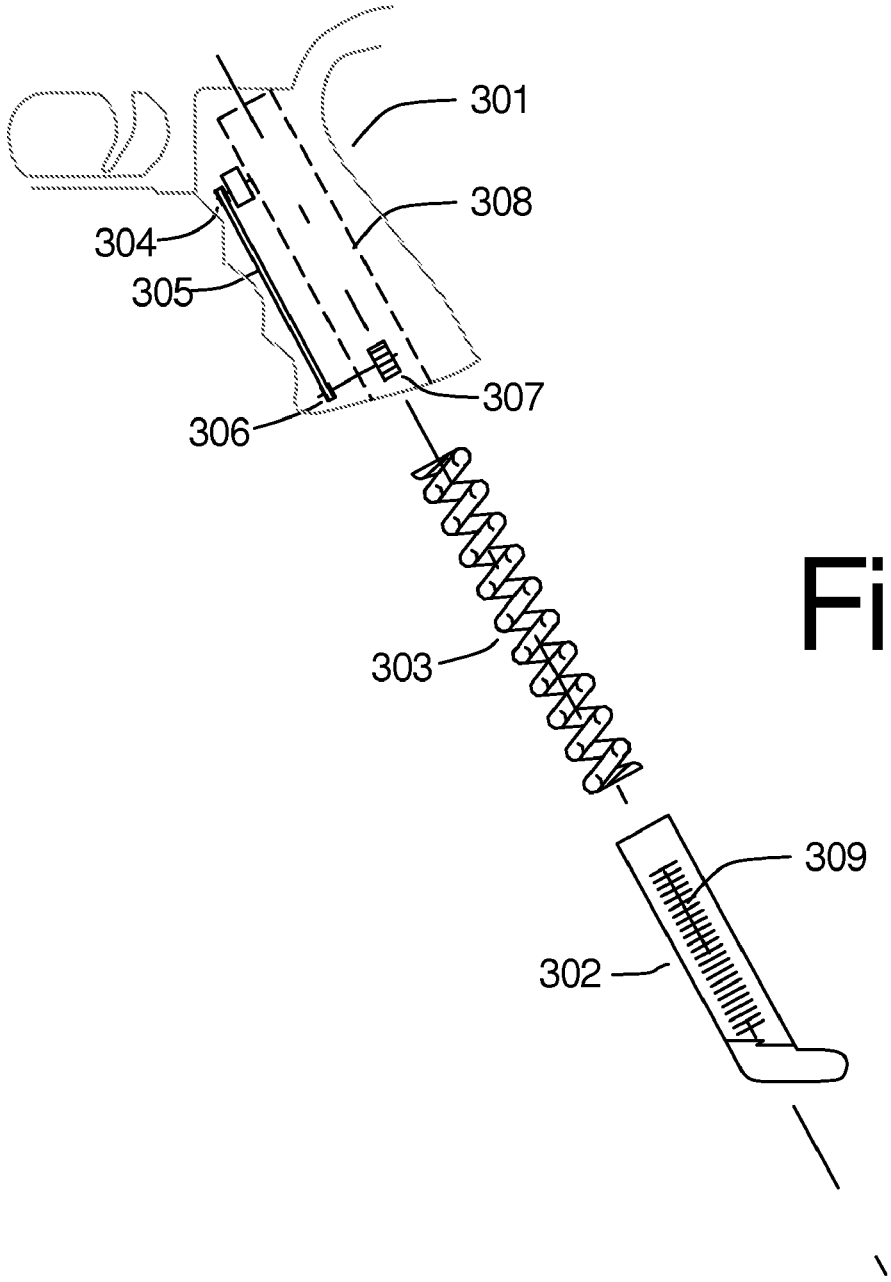
FIG. 3 is another exploded view of the grip assembly.

FIG. 3 shows this feature. Similar to the previous figure, a grip 301 with an inner defined chamber 308 is used to house a support rod 302 and a spring 303. A button/gear assembly 304 is rotated by the shooter which drives a small belt 305 to a lower gear 306 which is attached by a shaft to a lower extension rod gear 307. When the shooter rotates the button, the gear teeth rotate against the support rod teeth 309 and move the support rod in very fine increments, depending upon how the gearing/belting is designed. In a preferred embodiment, the belt 305 is a cogged belt to ensure positive movement between the gears at both ends, and optionally includes a tension developing means.

As a matter of convenience, it is important that the activation button can be activated by a left or right hand shooter, so the activation button may be located in a variety in positions, i.e. left hand, right hand or front middle of the grip. Also, in other embodiments of the invention, the button is pressed by any finger of the shooting hand, i.e. middle or ring fingers.

To adapt to a wide variety of field applications, the bottom of the support rod (foot pad) which contacts the shooting surface, may be smooth or textured i.e. ribbed, knurled, or spiked; and made from the same material as the rod itself. The foot pad may also be made from another material, i.e. rubber, to enhance surface contact; it may also be smooth or textured. The bottom of the foot pad may be a permanent part of the support rod, or may be detachable, such as by a screw, a snap, or Velcro.

In an embodiment of the invention, the grip handle is made from, but not limited to, engineered plastic, i.e. glass filled nylon or a polymer. The handle may also have another external layer i.e. rubber, to increase hand to handle grip.

In an embodiment of the invention, the support rod is made from, but not limited to, an engineered plastic, i.e. glass filled nylon or a polymer, and preferably, is reinforced with metal inserts, i.e. aluminum or steel.

In an embodiment of the invention, the support rod is a single solid piece. Alternately and equally, the support rod is designed to be telescoping and made out of two or more pieces.

In an embodiment of the invention, the support rod is made up of multiple pieces and spreads out when extended, i.e. a bipod, or tripod. In this case, the support rod is not a monopod.

In another embodiment, the features of FIG. 2 are combined with FIG. 3, so that pressing the button releases the support rod to move freely, and then rotating the button makes a fine adjustment of the support rod.

Figure 4:
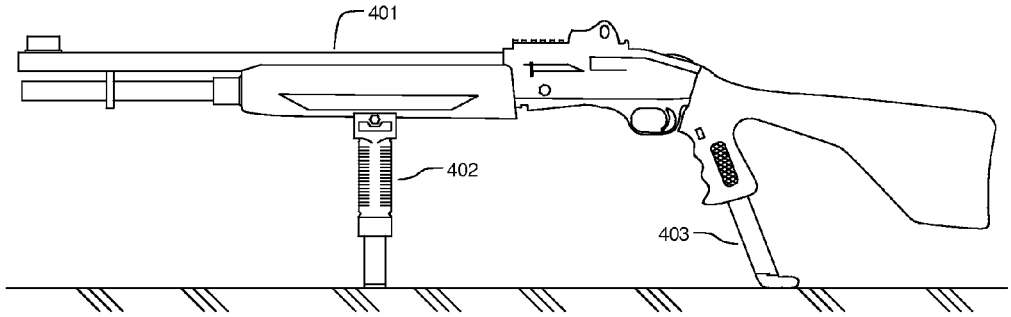
FIGS. 4 and 5 show how the invention is used with different types of long barreled guns.
Figure 5:
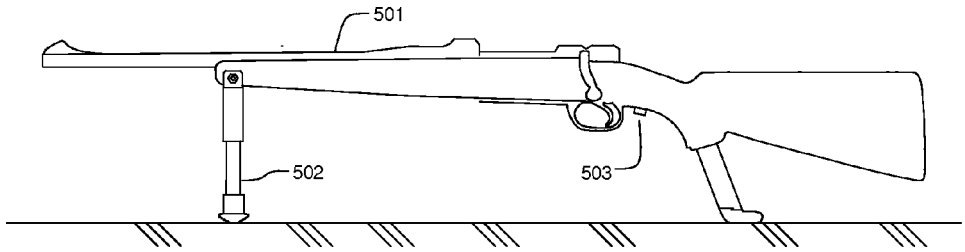

In FIG. 4, a shotgun 401 is shown with a bipod grip 402 along with a rear support rod 403. In FIG. 5, a rifle 501, such as a hunter's rifle, is shown with a bipod 502 and a button 503 which activates the rear support rod. The button 503 is in an area where the shooter would naturally grip the weapon for shooting.

While various embodiments of the present invention have been described, the invention may be modified and adapted to various operational methods to those skilled in the art. Therefore, this invention is not limited to the description and figure shown herein, and includes all such embodiments, changes, and modifications that are encompassed by the scope of the claims.

I claim:

1. An improved aiming method for a long barrel firearm comprising:

a) providing:
  i) a rear firearm grip handle,
  ii) a defined chamber within said rear firearm grip handle,
  iii) a spring and a support rod within said defined chamber, and
  iv) an activation button for said support rod and associated
    a) means for adjusting the extension of said support rod by manipulating said activation button, or
    b) support rod locking mechanism which is activated by said activation button, b) using a firing hand of a shooter to:
  i) manipulate said activation button to extend said support rod by use of said spring, and
  ii) allow said support rod to extend outwardly to a shooting surface, c) aiming said long barrel firearm on a target by use of both hands of said shooter, d) assisting the aim of said long barrel firearm on said target by controlling the extended length of said support rod against said shooting surface, e) wherein said manipulating of said activation button is at least one item selected from the group consisting of:
i) by rotating said activation button,
ii) by pressing said activation button, and
iii) by releasing said activation button.

2. The method according to claim 1 wherein said activation button is activated by a thumb or any other finger of said firing hand which is used to fire said long barrel firearm.

* * * * *